US005898027A

United States Patent [19]

Bardenberg et al.

[11] Patent Number: 5,898,027

[45] Date of Patent: Apr. 27, 1999

[54] TRANSPARENT SOAP COMPOSITION AND BARS OF SOAP PRODUCED THEREFROM

[75] Inventors: Gerd Bardenberg, Roetgen, Germany; Johannes Dijkers, Landgraaf, Netherlands; Aleksander Zajac, Eschweiler, Germany

[73] Assignee: Dalli-Werke Waesche- und Koerperpflege GmbH & Co., KG, Stolberg, Germany

[21] Appl. No.: 08/870,014

[22] Filed: Jun. 5, 1997

[30] Foreign Application Priority Data

Jun. 18, 1996 [DE] Germany ..... 196241626

[51] Int. Cl.[6] ..... C11D 9/00; C11D 13/00; C11D 17/00

[52] U.S. Cl. ..... 510/483; 510/147; 510/447; 510/451

[58] Field of Search ..... 510/447, 451, 510/483, 147

[56] References Cited

U.S. PATENT DOCUMENTS

| | | | |
|---|---|---|---|
| 2,970,116 | 1/1961 | Kelly et al. | 252/368 |
| 3,864,272 | 2/1975 | Toma et al. | 252/125 |
| 4,490,280 | 12/1984 | Joshi et al. | 252/368 |
| 4,493,786 | 1/1985 | Joshi | 252/368 |
| 4,584,126 | 4/1986 | Joshi | 252/368 |
| 4,754,874 | 7/1988 | Haney | 206/77.1 |
| 5,417,876 | 5/1995 | Tokosh et al. | 252/108 |
| 5,496,489 | 3/1996 | Dussault et al. | 252/134 |
| 5,703,025 | 12/1997 | Zyngier et al. | 510/147 |

FOREIGN PATENT DOCUMENTS

| | | |
|---|---|---|
| 58-162700 | 9/1983 | Japan . |
| 2 126 603 | 3/1984 | United Kingdom . |

*Primary Examiner*—Douglas J. McGinty
*Assistant Examiner*—John M Petruncio
*Attorney, Agent, or Firm*—Keil & Weinkauf

[57] ABSTRACT

Transparent extrudable soap composition which comprises neither lanolin constituents nor triethanol-amine which is free or bonded to fatty acids nor lower monohydric alcohols, and which comprises, based on the total weight: 65–80% by weight of soap base, produced with alkali metal hydroxide, of 75–85 parts by weight of tallow and palm oil fatty acids and 25–15 parts by weight of coconut oil and palm kernel oil fatty acids having a content of free alkali metal hydroxide of up to 0.06% by weight or a content of free fatty acids of up to 0.5% by weight, 0.2–0.6% by weight of NaCl and 20–7% by weight of a polyol mixture comprising 1,2-propylene glycol, sorbitol and glycerol and a weight ratio of 1.8–2.5:1:2–5, and the remainder to make up 100% by weight as water and customary auxiliaries and additives.

15 Claims, No Drawings

TRANSPARENT SOAP COMPOSITION AND BARS OF SOAP PRODUCED THEREFROM

PRIOR ART

Translucent or transparent bars of soap are known. They are produced from soap compositions which comprise transparency-improving additives or crystallization-preventing agents of varying compositions.

EP-A-633 312, DE-A-41 07 712 and U.S. Pat. No. 4,754,874 discloses pourable transparent soap compositions having a proportion of fatty acids in the soap base of significantly less than 50% by weight.

According to the reference 'Chemical Abstracts 101-9122' on JP-83,162,700, the transparent soap is said to comprise 15–75 parts of Na soaps, 5–60 parts of glycols and 0.1–30 parts of Na acylglutamic acid, i.e. the soap proportion can be between 20% by weight and 66.7% by weight. In the example the soap proportion is 41.2% by weight.

GB-A-2,126,603 discloses transparent bars of soap which comprise 45 to 90% by weight of a mixture of tallow and coconut oil soap, about 1 to 10% by weight of a lanolin soap or lanolin fatty acids and 5 to 25% by weight of water. In addition to the transparency-imparting lanolin soaps, 2 to 12% of a polyol having 3 to 6 carbon atoms and 2 to 6 hydroxyl groups can optionally also additionally be present as an agent which prevents crystallization. Preferred polyols are glycerol and sorbitol. Propylene glycol, polyethylene glycol and hydrogenated castor oil can furthermore additionally be present. The advantage of using lanolin constituents is that the additional crystallization-preventing constituents are not necessary.

U.S. Pat. No. 3,864,272 discloses a transparent soap of a soap base of 70–85% by weight of tallow fatty acids and 15–30% by weight of coconut oil fatty acids and of a mixture of sodium hydroxide and potassium hydroxide. 0.4% by weight of salt, such as sodium chloride, can be present. After drying, 1–3% by weight of polyethylene glycol and/or propylene glycol is incorporated in order to ensure the transparency. 1–3% by weight of glycerol can also additionally be used.

The known translucent soap mixtures require intensive mechanical processing and shearing of the partly dried soap composition and further heat treatment steps in order to permanently ensure the transparency.

The object of the present invention is to provide a soap composition for the production of transparent bars of soap which requires no particular processing operations, such as shearing or heat treatment before extrusion to strands of soap, and nevertheless results in a bar of good transparency.

SUMMARY OF THE INVENTION

This object is achieved by a transparent extrudable soap composition which comprises neither lanolin constituents nor triethanolamine which is free or bonded to fatty acids nor lower monohydric alcohols, and which comprises, based on the total weight:

(i) 65–80% by weight of soap base, produced with alkali metal hydroxide, of 75–85 parts by weight of tallow and palm oil fatty acids and 25–15 parts by weight of coconut oil or palm kernel oil fatty acids or a mixture thereof, the parts by weight in each case resulting in 100 parts by weight, having a content of free alkali metal hydroxide of up to 0.06% by weight or a content of free fatty acids of up to 0.5% by weight, (ii) 0.2 to 0.6% by weight of NaCl and (iii) 20–7% by weight of a polyol mixture comprising propylene glycol, sorbitol and glycerol and (iv) the remainder to make up 100% by weight as water and, if appropriate, the customary auxiliaries and additives.

The invention also relates to a process for the production of transparent bars of soap by extrusion of a soap composition of the above composition and division of the strand and compression molding of the strand sections.

Another embodiment of the invention relates to a process for the preparation of soap chips from the transparent soap composition described above by introducing the polyol mixture into the soap base, if appropriate drying the mixture and shaping soap chips.

The subclaims describe preferred embodiments of the soap composition.

DETAILED DESCRIPTION OF THE INVENTION

It has been found, completely surprisingly, that it is possible to form a salt-containing soap base which comprises none of the customary transparency-imparting lanolin constituents, i.e. lanolin soaps or free lanolin, in a transparent and extrudable manner by addition of a polyol mixture comprising 1,2-propylene glycol, sorbitol and glycerol without special treatment steps being necessary after mixing of the constituents in order to obtain and permanently ensure the desired transparency or the translucency of the soap.

A soap is regarded as transparent or translucent if objects behind it are to be detected as though the soap were a vitreous material, the soap allowing light to pass through in scattered form,. however, such that the object behind the soap can no longer be clearly detected. Test methods for transparency or translucency as terms known generally to the expert in soaps are described, for example, in U.S. Pat. No. 2,970,116 or are known from the Colgate-Joshi transparency test.

The weight ratio of 1,2-propylene glycol:sorbitol:glycerol can be 1.8–2.5:1:2–5. A particularly preferred ratio is 2:1:3.7. The weight data in each case relates to the 100% product of the polyol constituent.

The proportion of the mixture of crystallization-preventing polyols in the soap composition is 7–20% by weight, preferably 10–15% by weight, based on the total weight of the composition.

To facilitate the incorporation of sorbitol into the soap base, it can be employed in the form of a stable, approximately 70% strength aqueous solution, it also being possible to use other commercially available aqueous solutions of appropriate concentration.

Glycerol is advantageously employed as a commercially available aqueous 87% strength solution. However, it is also possible to use other concentrations of glycerol solutions.

If a soap base mixture which is obtained directly by hydrolysis of corresponding animal or vegetable fats and already comprises free glycerol is used, this glycerol content is to be taken into account in the amount of polyol to be incorporated. The soap base used for the extrudable composition according to the invention can be obtained by hydrolysis of animal and vegetable fats or by neutralization of fatty acids of animal and vegetable products with alkali metal hydroxide. The preferred hydroxide is sodium hydroxide, but up to about 5% by weight, under certain circumstances even up to 10% by weight, of KOH can be also be co-used.

The oils, fats or fatty acids (tallow and palm oil fatty acids or coconut oil and palm kernel oil fatty acids) can be processed to soap base in soap boilers or other suitable neutralization devices. The further constituents are then incorporated into the soap base in customary mixing devices. In addition to salt and the polyol mixtures, other customary auxiliaries and additives can also be co-used. These include, in particular, perfumes, dyestuffs, pigments and pearlescent pigments (mica-based), bactericides, antioxidants and the like. The amount of these customary auxiliaries and additives is usually 1–5% by weight in total, based on the total weight, the amount of the individual constituents being correspondingly lower and not exceeding 2% by weight in an individual case.

The soap composition is then dried to a residual water content of about 5–20% by weight by customary processes.

The customary auxiliaries and additives, like the polyols, can be first incorporated after drying of the soap base composition. However, it is preferable already to incorporate the polyol mixture before drying, while perfume and dyestuffs and other customary auxiliaries are as a rule incorporated into the mixture with customary devices only after drying.

After drying, the soap composition according to the invention is translucent or transparent and requires no additional treatment in order to permanently ensure transparency.

The resulting mixture can be converted into the form of soap flakes, it being possible for auxiliaries, such as perfume, color-donating additives, stabilizers, antioxidants and bactericides to be incorporated into the soap flakes only later, during final processing.

To produce transparent or translucent bars of soap in large quantities, the dried soap composition is compacted by extrusion to a strand and the final bars of soap, which can be packaged directly, are then obtained by cutting and/or pressing. Bars of soap are obtained from soap flakes, after any desired incorporation of the customary auxiliaries and additives, by using extruders or vacuum strand-forming devices and dividing up the strands and pressing them to bars of soap.

EXAMPLE 1

A soap was prepared from a mixture of 20% by weight of coconut oil fatty acid and 80% by weight of tallow fatty acid, a free alkali content of 0.04% of NaOH and a content of sodium chloride of 0.3% by weight, based on the solids in the soap, remaining. 2% of sorbitol (70% strength in water), 3% of 1,2-propylene glycol and 6% of glycerol (87% strength in water) were then admixed and the mixture was dried to a water content of about 16–17% by weight, based on the total weight. After processing to noodles, the visible transparency thereof was good. The noodles were processed to a continuous strand in a vacuum strand-forming device or in an extruder. This strand was cut and then stamped, in order to obtain bars of soap. The resulting bars of soap are of very good transparency.

In this example, customary additives and auxiliaries have consciously been omitted, in order to demonstrate that the polyol mixture is essential according to the invention for producing the transparency.

EXAMPLE 2

A boiler soap was prepared from a mixture of 20% by weight of palm kernel oil fatty acid and 80% by weight of palm oil fatty acid, a free fatty acid proportion of 0.2% of FFA and a sodium chloride content of 0.4% by weight, based on the solids in the soap, remaining. 3% of sorbitol (70% strength in water), 2% of 1,2-propylene glycol and 6% of glycerol (87% strength in water) were then admixed and the mixture was dried to a water content of about 16–17%.

After processing to soap noodles, the visible transparency thereof was good. Perfume and dyestuff were added to the noodles in a vacuum strand-forming device or an extruder and a continuous strand was then extruded therefrom. This was cut and then pressed in order to obtain bars of soap. The bars of soap thus produced have a very good transparency.

EXAMPLE 3

A boiler soap was prepared from a mixture of 17% by weight of palm kernel oil fatty acid and 83% by weight of tallow fatty acid, a free alkali content of 0.03% by weight and a sodium chloride content of 0.45%, based on the solids in the soap, remaining. 6% of glycerol (87% strength in water) was then admixed and the soap base was dried to a water content of about 13% by weight.

3% of sorbitol (70% strength in water), 1.5% by weight of 1,2-propylene glycol and 0.5% of perfume were added, in a mixer, to the noodles produced therefrom. The noodles were then extruded in an extruder to give a strand, and this was cut up and pressed to bars of soap.

The resulting bars of soap have a good transparency.

EXAMPLE 4

A pearlescent pigment was added, before extrusion, to the transparent soap flakes obtained according to Examples 1, 2 or 3 in order to achieve a striped, nacreous-like impression after processing to bars of soap.

EXAMPLE 5

Natural products, such as oat flakes, poppy, wheat germ, jojoba lapis (flora beads) or similar substances, were added to the transparent soap noodles obtained according to Examples 1, 2 or 3 before the processing to bars of soap in order to impart a desired natural impression to the bars of soap produced therefrom.

The finished bars of soap had a good transparency and allowed the additives to be detected.

We claim:

1. A transparent extrudable soap composition which comprises neither lanolin constituents nor triethanolamine which is free or bonded to fatty acids nor fatty acids nor lower monohydric alcohols, and consisting essentially of, based on the total weight:

i) 65–80% by weight of soap base, produced with alkali metal hydroxide, of 75–85 parts by weight of tallow or palm oil fatty acids or a mixture thereof, and 25–15 parts by weight of coconut oil or palm kernel oil fatty acids or a mixture thereof, the parts by weight in each case resulting in 100 parts by weight, having a content of free alkali metal hydroxide of up to 0.06% by weigh or a content of free fatty acid of up to 0.5% by weight, ii) 0.2 to 0.6% by weight of NaCl, and iii) 20–7% by weight of a polyol mixture consisting of 1,2-propylene glycol, sorbitol and glycerol in a weight ratio of 1.8–2.5:1:2–5, and iv) the remainder to make up 100% by weight as water.

2. The transparent soap composition defined in claim 1, wherein the weight ratio of 1,2-propylene glycol:sorbitol:glycerol is 2:1:3.7.

3. The transparent soap composition defined in claim 1, wherein the proportion of the polyol mixture (iii) is 15–10% by weight.

4. A process for the preparation of a transparent bar of soap which comprises a) extruding a transparent soap composition which comprises neither lanolin constituents nor triethanolamine which is free or bonded to fatty acids nor fatty acids nor lower monohydric alcohols, said soap composition consisting essentially of, based on the total weight:

i) 65–80% by weight of soap base, produced with alkali metal hydroxide, of 75–85 parts by weight of tallow or palm oil fatty acids or a mixture thereof, and 25–15 parts by weight of coconut oil or palm kernel oil fatty acids or a mixture thereof, the parts by weight in each case resulting in 100 parts by weight, having a content of free alkali metal hydroxide of up to 0.06% by weigh or a content of free fatty acid of up to 0.5% by weight, ii) 0.2 to 0.6% by weight of NaCl, and iii) 20–7% by weight of a polyol mixture consisting of 1,2-propylene glycol, sorbitol and glycerol in a weight ratio of 1.8–2.5:1:2–5, and iv) the remainder to make up 100% by weight as water, to give an extruded strand, b) dividing up the extruded strand, and c) impression molding the divided strand sections.

5. A process for the preparation of soap chips from a transparent soap composition which comprises neither lanolin constituents nor triethanolamine which is free or bonded to fatty acids nor fatty acids nor lower monohydric alcohols, said soar composition consisting essentially of, based on the total weight:

i) 65–80% by weight of soap base, produced with alkali metal hydroxide, of 75–85 parts by weight of tallow or palm oil fatty acids or a mixture thereof, and 25–15 parts by weight of coconut oil or palm kernel oil fatty acids or a mixture thereof, the parts by weight in each case resulting in 100 parts by weight, having a content of free alkali metal hydroxide of up to 0.06% by weight or a content of free fatty acid of up to 0.5% by weight, ii) 0.2 to 0.6% by weight of NaCl, and iii) 20–7% by weight of a polyol mixture consisting of 1,2-propylene glycol, sorbitol and glycerol in a weight ratio of 1.8–2.5:1:2–5, and iv) the remainder to make up 100% by weight as water, which process comprises introducing the polyol mixture into the soap base, and shaping soap chips.

6. The transparent soap composition defined in claim 1, further containing customary auxiliaries and additives.

7. The transparent soap composition defined in claim 1, further containing from 1 to 5% by weight of customary auxiliaries and additives.

8. The transparent soap composition defined in claim 6, wherein the customary auxiliaries and additives are selected from the group of perfumes, dyestuffs, pigments and pearl pigments, bactericides and antioxidants.

9. The process defined in claim 4, wherein the soap composition further contains customary auxiliaries and additives.

10. The process defined in claim 4, wherein the soap composition further contains from 1 to 5% by weight of customary auxiliaries and additives.

11. The process defined in claim 9, wherein the customary auxiliaries and additives are selected from the group of perfumes, dyestuffs, pigments and pearl pigments, bactericides and antioxidants.

12. The process defined in claim 5, wherein the soap composition further contains customary auxiliaries and additives.

13. The process defined in claim 5, wherein the soap composition further contains from 1 to 5% by weight of customary auxiliaries and additives.

14. The process defined in claim 12, wherein the customary auxiliaries and additives are selected from the group of perfumes, dyestuffs, pigments and pearl pigments, bactericides and antioxidants.

15. The process defined in claim 5, further comprising drying the soap base prior to the shaping of the soap chips.

* * * * *

UNITED STATES PATENT AND TRADEMARK OFFICE

CERTIFICATE OF CORRECTION

PATENT NO. :5,898,027
DATED :April 27, 1999
INVENTOR(S) :Gerd Bardenberg, et al.

It is certified that error appears in the above-indentified patent and that said Letters Patent is hereby corrected as shown below:

Col. 5, claim 5, line 37, "soar" should be --soap--.

Signed and Sealed this

Fifth Day of October, 1999

*Attest:*

Q. TODD DICKINSON

*Attesting Officer*

*Acting Commissioner of Patents and Trademarks*